US006851361B2

(12) United States Patent
Görbing et al.

(10) Patent No.: US 6,851,361 B2
(45) Date of Patent: Feb. 8, 2005

(54) REVERSING OR TURNING ASSEMBLY OF A SHEET-PROCESSING MACHINE

(75) Inventors: Christian Görbing, Heidelberg (DE); Karl-Heinz Helmstädter, Heidelberg (DE); Raimund Schröder, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/417,569

(22) Filed: Apr. 17, 2003

(65) Prior Publication Data

US 2003/0196563 A1 Oct. 23, 2003

(30) Foreign Application Priority Data

Apr. 17, 2002 (DE) ..... 102 17 134

(51) Int. Cl.[7] ..... B41F 5/02
(52) U.S. Cl. ..... 101/230; 101/246
(58) Field of Search ..... 101/230, 246, 101/223, 229, 219

(56) References Cited

U.S. PATENT DOCUMENTS

| | | | | | |
|---|---|---|---|---|---|
| 4,186,662 | A | * | 2/1980 | Borneman | 101/218 |
| 4,414,896 | A | * | 11/1983 | Fischer | 101/211 |
| 4,535,691 | A | * | 8/1985 | Kida | 101/230 |
| 4,662,277 | A | * | 5/1987 | Fischer | 101/230 |
| 4,688,784 | A | * | 8/1987 | Wirz | 271/195 |
| 4,796,529 | A | * | 1/1989 | Mathes | 101/230 |
| 4,869,166 | A | * | 9/1989 | Mathes | 101/230 |
| 5,156,090 | A | * | 10/1992 | Wirz | 101/142 |
| 5,271,323 | A | * | 12/1993 | Munker | 101/409 |
| 5,839,366 | A | * | 11/1998 | Schaede | 101/232 |
| 6,254,094 | B1 | | 7/2001 | Becker et al. | |
| 6,401,610 | B1 | | 6/2002 | Becker et al. | |
| 6,662,722 | B2 | * | 12/2003 | Frankenberger et al. | 101/232 |

FOREIGN PATENT DOCUMENTS

| | | |
|---|---|---|
| DE | 44 24 977 C2 | 1/1996 |
| DE | 198 33 901 A1 | 2/2000 |
| EP | 0 185 965 B1 | 7/1986 |
| EP | 0 158 129 B1 | 8/1988 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A reversing or turning assembly of a sheet-processing machine includes an impression cylinder having a circumferential surface for transporting sheets thereon for printing the sheets in a printing nip associated with the impression cylinder. Gripper devices are provided for gripping the printed sheets at a respective trailing edge thereof and for lifting the gripped sheets off the impression cylinder for reversing the gripped sheets. The circumferential surface of the impression cylinder is formed with recesses in a region thereof occupied by the trailing edge of the sheets, for permitting the gripper devices to penetrate or dip into the recesses to grip the sheet trailing edge. The recesses have a position being variable in circumferential direction of the circumferential surface of the impression cylinder for adapting to different sheet formats.

13 Claims, 7 Drawing Sheets

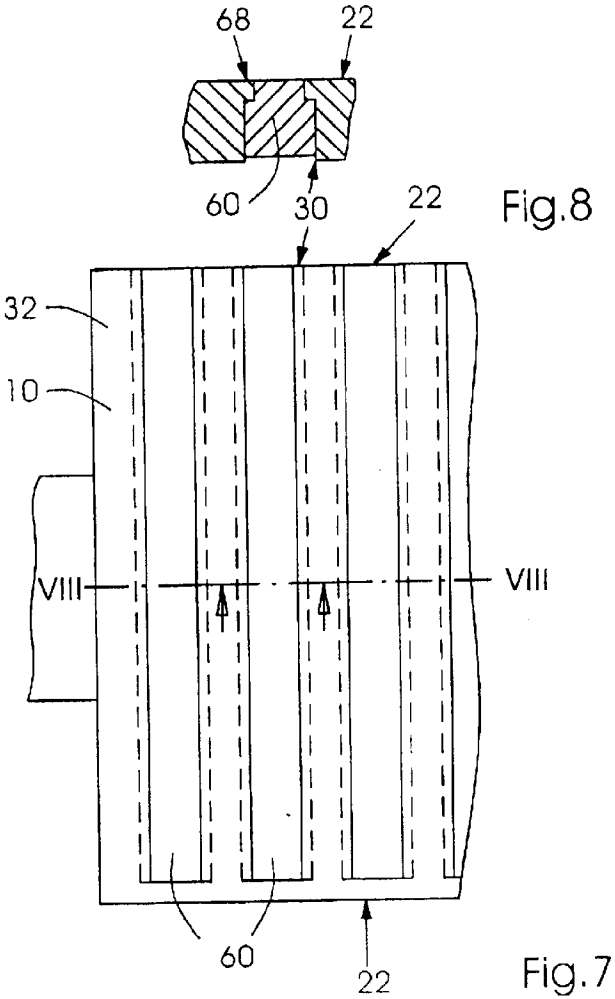
Fig.8
Fig.7
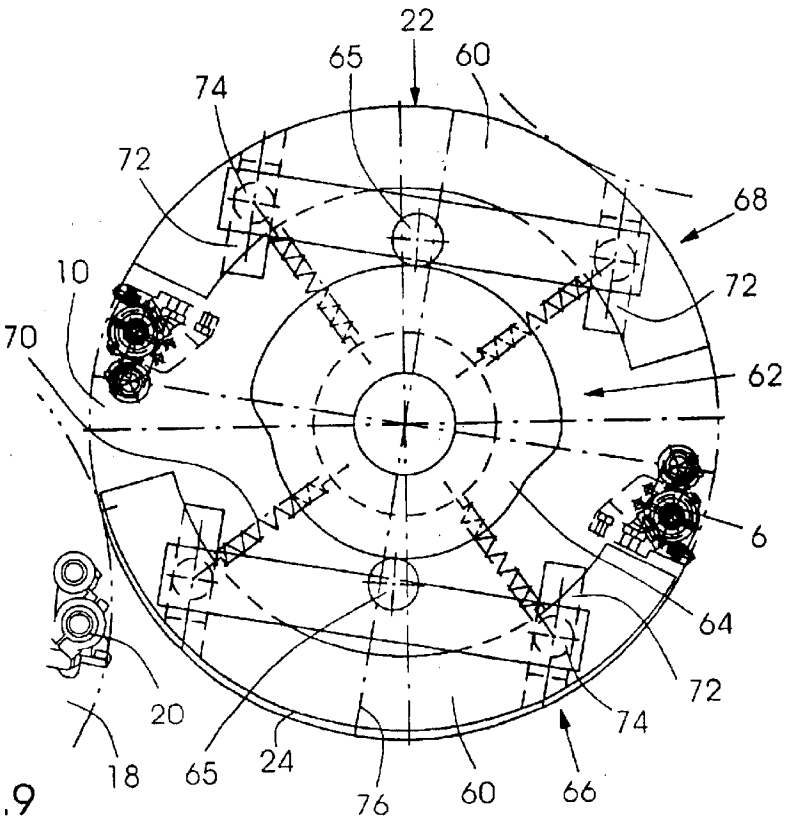
Fig.9

REVERSING OR TURNING ASSEMBLY OF A SHEET-PROCESSING MACHINE

BACKGROUND OF THE INVENTION

Field of the Invention

The invention relates to a reversing or turning assembly of a sheet-processing machine, in particular a sheet-fed rotary printing press, having an impression cylinder. Sheets which are transported on a circumferential surface of an impression cylinder and printed in an associated printing nip formed between the impression cylinder and a blanket cylinder are gripped at a trailing edge thereof and lifted off the impression cylinder for the purpose of being reversed or turned.

In sheet-fed rotary printing presses, the paper sheets to be printed are taken from a sheet pile and, with the aid of grippers disposed on rotating cylinders, are transported through individual printing units of the printing press, wherein they are printed with one, two or several colors in respective printing nips of the printing units. In that regard, as noted hereinabove, the printing nips are respectively formed between blanket cylinders, which transfer the printing images for the individual colors, and respective impression cylinders, which are set with great pressure against the blanket cylinders.

In the heretofore-known sheet-fed rotary printing presses, the reversing or turning of the sheets is performed with the aid of reversing or turning devices including one or more suction grippers which are pivotable out of the periphery of a cylinder belonging to the reversing or turning device, grip the sheets to be reversed or turned at respective trailing edges thereof and, after the suction grippers have pivoted back into the periphery of the cylinder, transfer the sheets to a further gripping device. After taking over or accepting the sheet trailing edge, the further gripping device is pivoted counter to the direction of rotation of a rotating cylinder of the reversing or turning device, and transfers the sheet trailing edge as a new sheet leading edge to the gripper device of a cylinder located downstream therefrom, for example the grippers of an impression cylinder of the printing unit downstream from the reversing or turning device, in order to print the rear side of the sheet.

In that regard, in particular due to increasing printing speeds, a problem arises in practice that the suction grippers, in order to grip the sheet trailing edge, have to pivot very far out of the periphery of the reversing or turning drum in order to have sufficient time for gripping and transferring the trailing edge of the sheet before reaching the transfer center line. In other words, before reaching the connecting line between the rotational centers of the reversing or turning drum and the upstream impression cylinder.

Furthermore, for a timely correct takeover or acceptance of the sheets, the suction grippers must pass through a complex path of movement. That is achievable only by mechanically complex mechanisms which, in addition, have to absorb considerable forces at high printing speeds.

In addition, due to the fact that suction is applied to the sheets by suction grippers during the reversing or turning of the sheets, a problem arises that the respective trailing edges of the sheets are no longer transferred with the usual precision experienced by using conventional mechanical sheet grippers or tongs-type grippers. Due to that problem, it is possible for the printing images on the front and rear of a sheet printed on both sides to be displaced.

German Published, Non-Prosecuted Patent Application DE 198 33 903 A1, corresponding to U.S. Pat. No. 6,401,610, describes a method and a device for transferring the trailing edge of a sheet in a reversing or turning device of a sheet-fed rotary printing press. In that device and method, the sheets are gripped at a trailing edge thereof by a gripper device, in accordance with the principle of reversing or turning the sheet trailing edge, and are lifted off an impression cylinder disposed upstream therefrom. In order to separate or loosen the sheet trailing edge from the impression cylinder, provision is made, in that regard, for blowing under the sheet trailing edge with blast air which emerges from a nozzle directed towards the circumferential surface of the impression cylinder and from blast air holes respectively formed in the circumferential surface of the impression cylinder. The text of those publications makes no reference to providing recesses in the circumferential surface of the impression cylinder, into which the gripper device can dip when gripping the sheet trailing edge.

The aforementioned German Published, Non-Prosecuted Patent Application DE 198 33 903 A1, corresponding to U.S. Pat. No. 6,401,610, describes a reversing or turning device in a sheet-fed rotary printing press wherein, for the reversing or turning operation, the trailing edge of a sheet is lifted off the circumferential surface of the upstream impression cylinder by a suction gripper that pivots out from the periphery of a reversing or turning drum and transfers the trailing edge of the sheet to a further gripper device disposed within the periphery of the reversing or turning drum. Due to the use of a suction gripper, in particular at high production printing speeds, an in-register sheet transfer is not assured.

SUMMARY OF THE INVENTION

It is accordingly an object of the invention to provide a reversing or turning assembly of a sheet-processing machine, which overcomes the hereinafore-mentioned disadvantages of the heretofore-known devices of this general type and which, even at high printing speeds, permits a highly precise transfer of the sheet trailing edge to a gripper device of a downstream reversing or turning drum.

With the foregoing and other objects in view, there is provided, in accordance with the invention, a reversing or turning assembly of a sheet-processing machine, comprising an impression cylinder having a circumferential surface for transporting sheets thereon for printing the sheets in a printing nip associated with the impression cylinder, and gripper devices for gripping the printed sheets at a respective trailing edge thereof and for lifting the gripped sheets off the impression cylinder for the purpose of reversing the gripped sheets. The circumferential surface of the impression cylinder is formed with recesses in a region thereof occupied by the trailing edge of the sheets, for permitting the gripper devices to penetrate or dip into the recesses in order to grip the sheet trailing edge. The recesses have a position which is variable in circumferential direction of the circumferential surface of the impression cylinder for adapting to different sheet formats.

In accordance with another feature of the invention, the combination further includes closure elements for closing the recesses so that the circumferential surface, in a region thereof occupied by a printable region of a respective sheet, has a completely closed cylindrical shape when the closure elements are disposed within the recesses.

In accordance with a further feature of the invention, the circumferential surface of the impression cylinder is formed with grooves for accommodating the closure elements therein.

In accordance with an added feature of the invention, a plurality of the closure elements are disposed lying in a row on one another within a respective one of the grooves, and are movable jointly in longitudinal direction of the one groove. In this way, the position of the recesses for the gripper devices is variable in circumferential direction of the circumferential surface of the impression cylinder for adapting to different sheet formats.

In accordance with an additional feature of the invention, there are provided chains for holding the closure elements.

The chains, in the region of the circumferential surface of the impression cylinder that is occupied by the sheet leading edge, are guidable into the interior of the impression cylinder.

In accordance with yet another feature of the invention, there are provided suction devices disposed within a respective recess formed in the circumferential surface of the impression cylinder in the region thereof occupied by the trailing edge of the sheets. The suction devices are coupled with the movable closure elements and serve for applying a resilient tensioning force to the sheets.

In accordance with yet a further feature of the invention, there is provided a locking device for holding the closure elements in the recesses assigned thereto, and a removal device disposed outside the periphery of the impression cylinder for removing the closure elements from the assigned recesses in the radial direction after the locking device has been unlocked.

In accordance with yet an added feature of the invention, the locking device includes pulling elements assigned to the closure elements and, for fixing the closure elements, serving for acting upon the closure elements from inside the impression cylinder in an at least approximately radial direction. This is done for holding the closure elements on the impression cylinder.

In accordance with yet an additional feature of the invention, the removal device includes a suction head for removing the closure elements from the recesses after the locking device has been released.

In accordance with still another feature of the invention, the closure elements are formed by components which are reciprocatingly movable in radial direction between a retracted position and an extended position thereof periodically at an operating cycle rate of the sheet-processing machine.

In accordance with still a further feature of the invention, the components are circular-ring segment-shaped members curved in accordance with the curvature of the circumferential surface of the impression cylinder. The circular-ring segment-shaped members are formed with radially outer faces which, when the members are in the extended position thereof, form the circumferential surface of the impression cylinder for carrying the sheets and, when the members are in the retracted position thereof, form a base or bottom of the associated recesses.

In accordance with still an added feature of the invention, the combination further includes an actuating device braced against a central base member of the impression cylinder for reciprocatingly moving the circular-ring segment-shaped components between the extended position and the retracted position thereof.

With the objects of the invention in view, there is also provided a reversing or turning assembly of a sheet-processing machine, comprising an impression cylinder having a circumferential surface for transporting sheets thereon for printing the sheets in a printing nip associated with the impression cylinder. Gripper devices are provided for gripping the printed sheets at a respective trailing edge thereof and for lifting the gripped sheets off the impression cylinder for the purpose of reversing the gripped sheets. Rod-shaped closure elements are disposed in the circumferential surface of the impression cylinder. The closure elements are reciprocatingly movable periodically, at an operating cycle rate of the sheet-processing machine, in radial direction between a retracted position and an extended position thereof. The closure elements have an end face matched to the curvature of the circumferential surface of the impression cylinder, and serve for lifting away from the circumferential surface of the impression cylinder the trailing edge of the sheets to be reversed, for gripping the trailing edge by the gripper devices, after those sheets have passed through a printing nip formed between the impression cylinder and a blanket cylinder.

Thus, according to the invention, an impression cylinder in a reversing or turning device of a sheet-processing machine, in particular a sheet-fed rotary printing press, wherein the sheets transported on the circumferential surface of the impression cylinder and printed in an associated printing nip are gripped at the trailing edge thereof by a gripper device disposed on a downstream reversing or turning drum and lifted off the impression cylinder in order to be reversed or turned, is improved by the fact that the circumferential surface of the impression cylinder in the region of the sheet trailing edge is provided with recesses into which the gripper devices of the reversing or turning drum can dip or penetrate in order to grip the sheet trailing edge. In this regard, the position of the recesses in the circumferential direction of the cylinder can be varied in a manner according to the invention in order to adapt to different sheet formats.

In the preferred embodiment of the invention, the recesses can be closed by closure elements so that the circumferential surface of the impression cylinder in the printable region of a sheet has a completely closed cylindrical form if the closure elements are disposed within the recesses.

In this regard, in order to achieve high concentric running accuracy, it is advantageous if the closure elements are inserted beforehand into the recesses during the fabrication of the cylinder, and the cylinder with the inserted closure elements is subjected to grinding as one component. By this type of fabrication, it is possible to ensure in the same way that the closure elements, which preferably have end faces extending at an angle to the cylinder mid-axis in the radial direction do not form any gaps which lead to faults in the printed image as the printing nip is passed.

The closure elements can be cut out of the roughly machined circumferential surface of the impression cylinder, for example by a laser, in the desired form and can remain in the circumferential surface during the grinding operations.

In this regard, the closure elements are preferably supported on the radially inner side thereof on a central base member or body of the impression cylinder, whereon they preferably rest with the radially inner side thereof.

In a preferred embodiment of the invention, grooves which accommodate the closure elements are formed in the circumferential surface of the impression cylinder. In this regard, the grooves preferably extend or run beside one another in the circumferential direction of the impression cylinder, the axial position of each groove corresponding at least approximately to the position of the gripper device which, in order to accept the sheet trailing edge, dips or penetrates into the recesses respectively formed in the grooves. In this regard, the grooves preferably extend at least approximately along the region of the circumferential surface of the impression cylinder which is defined by the position of the trailing edge of the sheets with the smallest sheet format and the position of the trailing edge of the sheets with the largest sheet format during the acceptance of the sheet trailing edge by the gripping device of the downstream cylinder.

Within the grooves, the closure elements, which supplement the circumferential surface of the impression cylinder in the region of the sheet to be printed in the upstream printing nip to form a homogeneous flat surface, are advantageously preferably in a row with one another, so that a recess, which is defined by a missing closure element, is preferably produced only at the position at which the gripper devices penetrate into the circumferential surface of the impression cylinder in order to grip the sheet trailing edge during the reversing or turning operation.

In this regard, the closure elements lying on one another in a row within a groove can preferably be moved jointly in the longitudinal direction of the groove, so that the position of the recesses for the gripper devices can be varied automatically in the circumferential direction of the impression cylinder by appropriate actuating devices in order to adapt to different sheet formats. The result here is a very short changeover time of the sheet-processing machine when changing over from one sheet format to another.

In this regard, the closure elements can advantageously be held on chains, so that each closure element is at least approximately the length of a chain link, and the end faces of the individual closure elements on the chain links rest on one another in-register when the chain is positioned along the associated groove thereof formed in the circumferential surface of the impression cylinder.

In this embodiment of the invention, it may further be of advantage if the grooves extend along the printable area of the sheets with maximum sheet format and, in the region of the sheet leading edge grippers, open into the interior of the impression cylinder through openings formed between the sheet leading edge grippers. Thereby, the chains with the closure elements can be pulled into the impression cylinder in the region of the openings of the sheet leading edge grippers in order to adapt to the format, so that the position of the recess in the respective groove, which in this case is preferably defined by a missing closure element, i.e., one not connected to a chain link, can be varied by pulling the chain into the interior of the impression cylinder. In this regard, the chains can be constructed, for example, as endless chains, which can be guided out of the interior of the impression cylinder again through a further opening in the region of the sheet trailing edge, so that with a corresponding drive, for example with the aid of a sprocket located on the inside, simple and reliable positioning of the recess is made possible by displacing the chain.

Furthermore, in this embodiment of the invention, provision can be made for a suction device to be disposed at the chain link at which the associated closure element has been removed to form the recess, the suction device, for example, being coupled with the associated chain link via resilient element so that it is displaceable. This results in the advantage that a sheet to be turned or reversed can be gripped by the suction device in the region of the trailing edge thereof after the sheet has passed through the printing nip and, before the sheet is transferred, it can be tensioned by the gripping devices for gripping the sheet trailing edge, with the result that highly precise transfer of the sheet trailing edge may be achieved. Applying a resilient tensioning force to the sheet trailing edge and to the suction devices, respectively, can in this regard be achieved by a corresponding brief movement of the chain in the associated groove.

However, in the embodiment described previously, it is likewise conceivable to use toothed belts or generally flexible drives instead of the chains, fulfilling at least approximately the same function as a chain, the closure elements being supported on the flexible drives in the same way as in the case of a chain, at least at the side edges, to some extent on the central base member of the impression cylinder.

According to a further embodiment of the invention, the closure elements are, respectively, held individually in the recesses assigned thereto by locking devices and can be removed from the recesses in the radial direction, after the locking devices have been unlocked, either by hand or by a removal device disposed outside the periphery of the impression cylinder, for example a removal device disposed underneath the impression cylinder.

In this regard, the locking devices preferably include pulling elements, for example rods or hooks, which are assigned to the closure elements in order to fix the closure elements, acting upon the closure elements from the inside of the impression cylinder, preferably in an at least approximately radial direction, in order to urge the closure elements toward the central base member of the impression cylinder and in this way to hold them on the latter. The locking devices can be formed, for example, by rotatable rods with hook-shaped ends, the hook-shaped ends coming into contact with the radially inner side thereof with clamping surfaces formed on the respective closure element and running or extending at an angle to the axis of rotation of the impression cylinder, in order to urge the closure elements towards the central base member of the impression cylinder and clamp them to the latter.

The removal device for removing the respectively individually lockable closure elements from the respective grooves in the circumferential surface of the impression cylinder can, in this regard, advantageously include a suction head, which attracts the closure elements by suction after the locking devices have been released, pulls them out of the recess in the radial direction and, for example, subsequently removes them from the region of the circumferential surface of the impression cylinder by pivoting or swiveling the suction head.

According to a further embodiment of the invention, the closure elements are formed by elements that are moved reciprocatingly in the radial direction between a retracted position and an extended position thereof periodically at the operating cycle rate of the sheet-processing machine. These elements can be formed, for example, as bar-shaped or rod-shaped elements having an end face with a shape matched to the cylindrical shape of the circumferential surface of the impression cylinder.

In the preferred embodiment of the invention, however, the periodically moved closure elements are preferably formed by elements which have the shape of a segment of a circular ring and which are moved reciprocatingly between the extended position and the retracted position by an actuating device braced against the central base member of the impression cylinder, for example by eccentric cams which are rotatable at the machine cycle rate or else by control cams and cam rollers acting on the inside of the circular ring-shaped segments. In this regard, the movement is such that the circular-ring segment-shaped elements are disposed in the extended position as long as the sheet is passing the printing nip between the impression cylinder and the associated blanket cylinder, and only shortly after the sheet trailing edge has passed through the printing nip, are moved into the retracted position via the actuating device, so that the gripper devices for gripping the sheet trailing edge for the reversing or turning operation can dip or penetrate into the groove-shaped recesses formed for a short time in this way in the circumferential surface of the impression cylinder. In this regard, the radially outer faces of the circular-ring segment-shaped elements, when in the retracted position, form the base or bottom of the associated recesses into which the grippers for gripping the sheet trailing edge penetrate.

The combination according to the invention results overall in the advantage that the gripper or suction devices of the reversing or turning drum for gripping the sheet trailing edge no longer have to be pivoted or swiveled out from the periphery of the reversing or turning drum via complicated and mechanically highly loaded mechanisms in order to grip the sheet trailing edge before it passes the gripper center line and in order to guide the sheet trailing edge, after it is gripped, into the interior of the reversing or turning drum by pivoting or swiveling back into the periphery of the reversing or turning drum in order to transfer to a further gripper device, because, due to the penetration or dipping of the gripper device into the recesses, the transfer of the sheet trailing edge can be carried out immediately in a conventional manner in the vicinity of the transfer center line. Thereby, conventional tongs-type grippers can be used, which are fitted in an at least approximately stationary position on the reversing or turning drum, without requiring any complicated mechanism for the radial movement of the tongs-type grippers.

Other features which are considered as characteristic for the invention are set forth in the appended claims.

Although the invention is illustrated and described herein as embodied in a reversing or turning assembly of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 7 is a fragmentary, plan view of the circumferential surface of the impression cylinder of a further embodiment of the invention, wherein the closure elements are formed by segment-shaped elements which move periodically in the radial direction;

FIG. 8 is a fragmentary, cross-sectional view of FIG. 7 taken along the line VIII—VIII of FIG. 7, in the direction of the arrows;

FIG. 9 is an end-elevational view of FIG. 7, wherein circular-ring segment-shaped elements of the impression cylinder are shown accommodated symmetrically in guides disposed in the radial direction and are adjusted by a cam disc and cam rollers;

DESCRIPTION OF THE PREFERRED EMBODIMENTS

Figure 1:
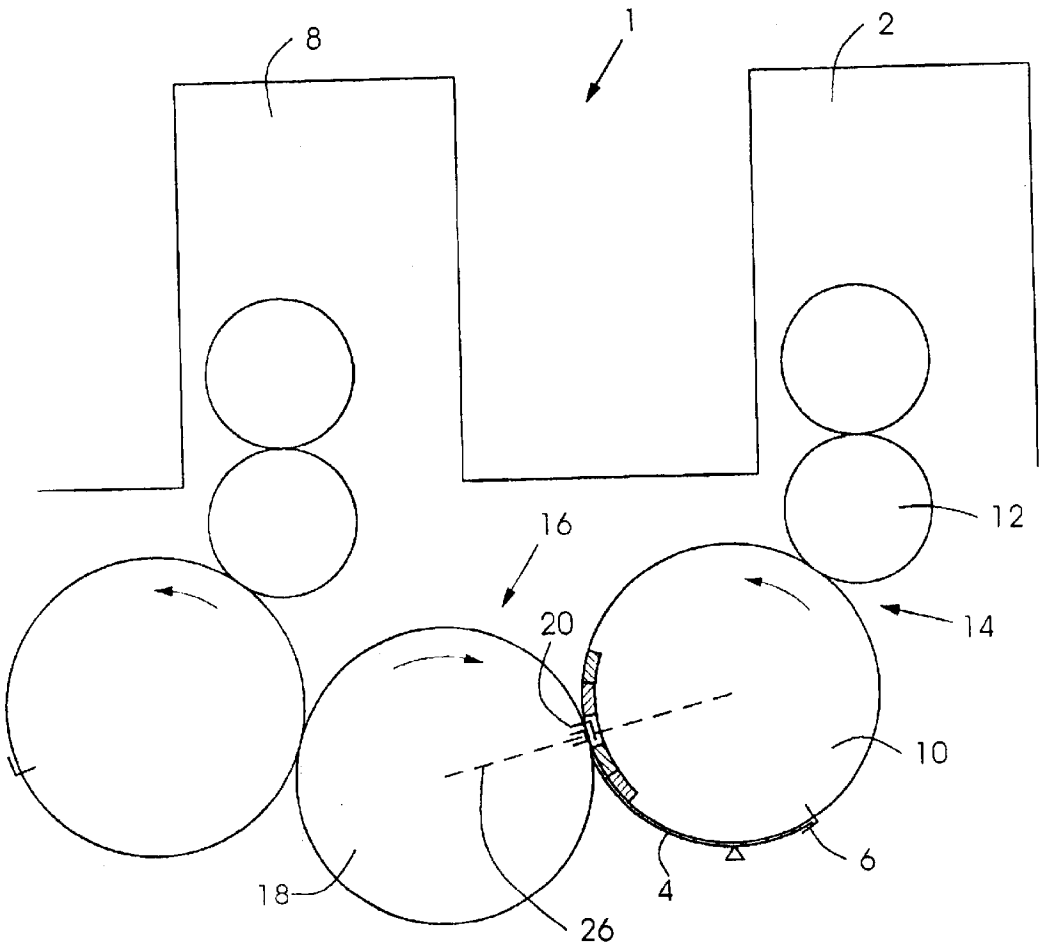
FIG. 1 is a diagrammatic, partly-sectional, side-elevational view of a sheet-fed rotary printing press having an impression cylinder, constructed in accordance with the invention.

Referring now in detail to the figures of the drawings and first, particularly to FIG. 1 thereof, there is seen a sheet-fed rotary printing press 1 according to the invention, which includes a first printing unit 2 having an impression cylinder 10 according to the invention which, with a blanket cylinder 12 associated therewith, forms a printing nip 14 for printing the top or front side of a sheet 4 which is transported on the impression cylinder 10 and which is held at a leading edge thereof by gripper devices 6 on the impression cylinder 10 as it passes the printing nip 14. Between the first printing unit 2 and a second printing unit 8 disposed downstream from the first printing unit 2, as viewed in the sheet transport direction, a reversing or turning device 16 is disposed, which has a reversing or turning drum 18 with gripper devices 20 which grip the sheet 4 at the trailing edge thereof, in order to lift the sheet off the impression cylinder 10 and feed it in reversed or turned condition, with the trailing edge thereof leading, to the second printing unit 8.

Figure 2:
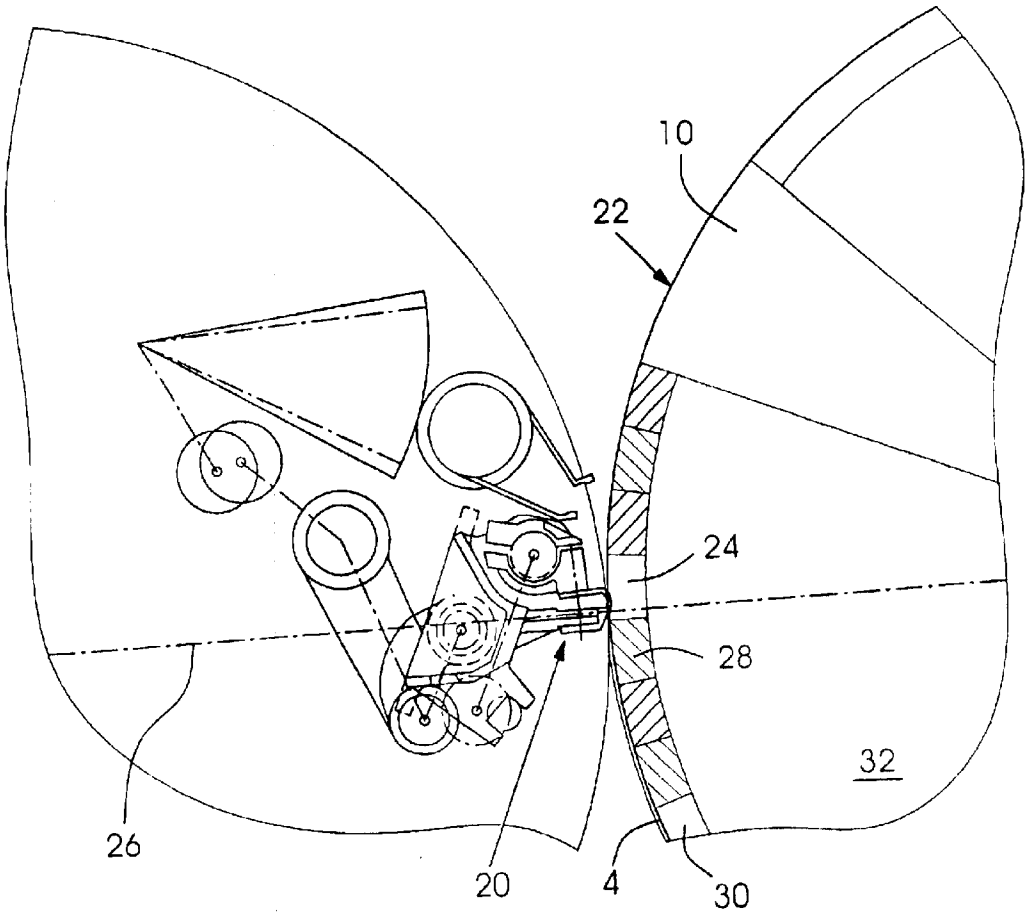
FIG. 2 is an enlarged, fragmentary view of FIG. 1, showing the impression cylinder according to the invention provided with removable closure elements, and a reversing or turning drum disposed downstream from the impression cylinder, as viewed in sheet travel direction through the printing press.

According to FIG. 2, the impression cylinder 10 according to the invention has recesses 24 formed in the circumferential surface 22 thereof, into which the gripper devices 20 for gripping the trailing edge of the sheet 4 dip or penetrate when the gripper devices 20 are located preferably in the vicinity of the gripper center line 26, which forms an imaginary connecting line between the rotational centers of the impression cylinder 10 and the reversing or turning drum 18.

As is shown further in detail in FIG. 2, the recesses 24 are closable by closure elements 28, which are accommodated in grooves 30 extending in the circumferential direction of the impression cylinder 10.

The closure elements 28 are supported on a central base member 32 of the impression cylinder 10 and, in this regard, lie in register within the grooves 30 so that, in the printable region of the sheet 4, a completely closed cylindrical circumferential surface is produced, which does not cause any detrimental effects upon or distortions of the printed image when a sheet gripped by the leading edge grippers 6 is transported through the printing nip 14.

Figure 3:
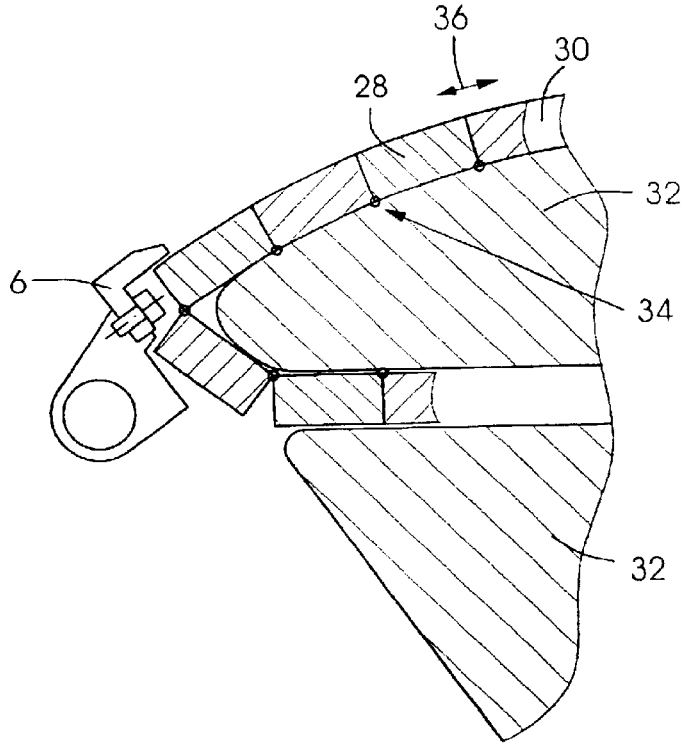
FIG. 3 is a further enlarged, fragmentary view of a different embodiment of the impression cylinder of FIG. 2, wherein the closure elements are fixed to chains which, in the vicinity of grippers for gripping the sheet leading edge, are guided into the interior of the impression cylinder.
Figure 4:
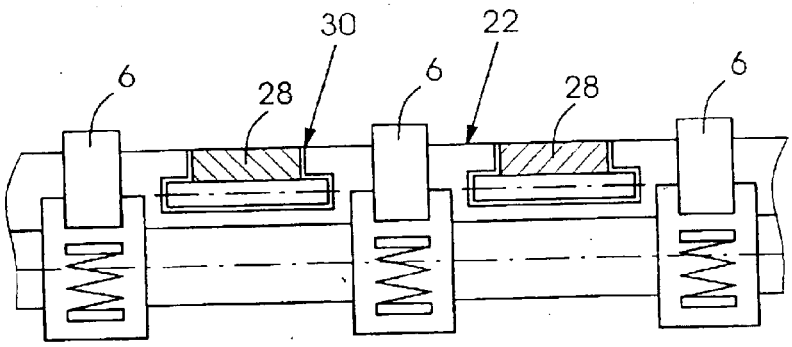
FIG. 4 is a fragmentary, slightly reduced, partly-sectional view as seen from the left-hand side of FIG. 3, at the level of the grippers for gripping the sheet leading edges.

According to FIGS. 3 and 4, in a preferred embodiment of the invention, the closure elements 28 are held on chains 34 which are reciprocatably movable along the grooves 30 formed in the impression cylinder 10, in the directions represented by the double-headed arrow 36 via a drive which is otherwise not specifically illustrated in FIG. 3 and which, in the vicinity of the leading-edge grippers 6, are inserted through an opening, not otherwise specifically identified, into the interior of the impression cylinder 10 or the central base member 32. By moving the chains 34 with the closure elements 28 secured thereto, the position of the respective recess 24 within a groove 30 can be changed in the circumferential direction of the impression cylinder 10 in order to adapt to different sheet formats, in particular sheet lengths. In this regard, all the recesses 24 disposed parallel to one another in the grooves 30 are preferably adjusted simultaneously.

Figure 5:
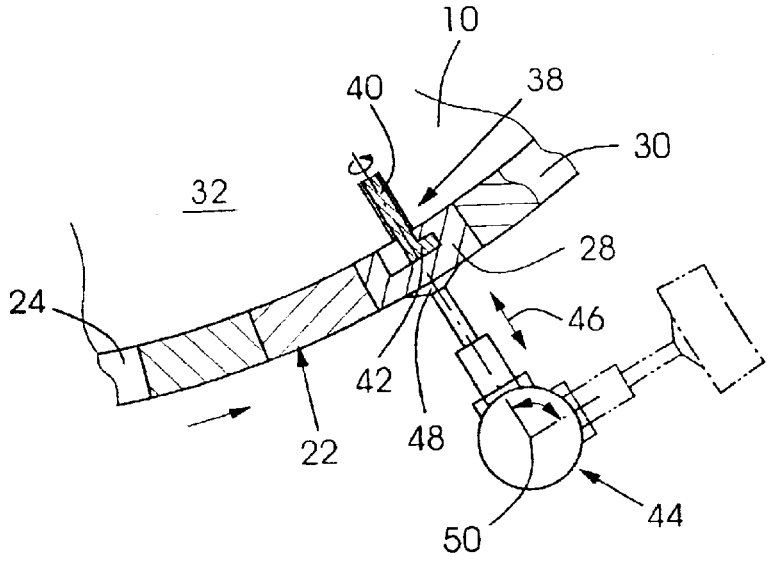
FIG. 5 is a fragmentary, sectional view of a further embodiment of the invention, wherein the closure elements are provided in such a way as to be removable from the circumferential surface of the cylinder in radial direction by a removal device having a suction head, after hook-shaped locking elements have been opened.

According to a further embodiment of the invention shown in FIG. 5, the closure elements 28 are removable radially from the grooves 30, and are held on the central base member 32 of the impression cylinder 10 by a locking device 38, which includes a rotatable rod 40 with a hook-shaped end 42 which, with the radially inner side thereof, acts upon a clamping face extending at an angle to the axis of rotation of the impression cylinder 10 but otherwise not specifically identified, in order to clamp the closure element 28 firmly to the central base member 32.

After unlocking the locking device 38, the removal of the closure elements 28 in the radial direction is performed with the aid of a removal device 44 which is preferably disposed underneath the impression cylinder 10 and includes a suction head 48 which is movable in the directions represented by the double-headed arrow 46 and which, in order to take the removed closure element 28 away from the circumferential surface 22 of the impression cylinder 10, is swivellable about an axis 50. The swiveled-away position of the suction head 48 with the closure element 28 located thereon is represented in phantom in FIG. 5.

Figure 6:
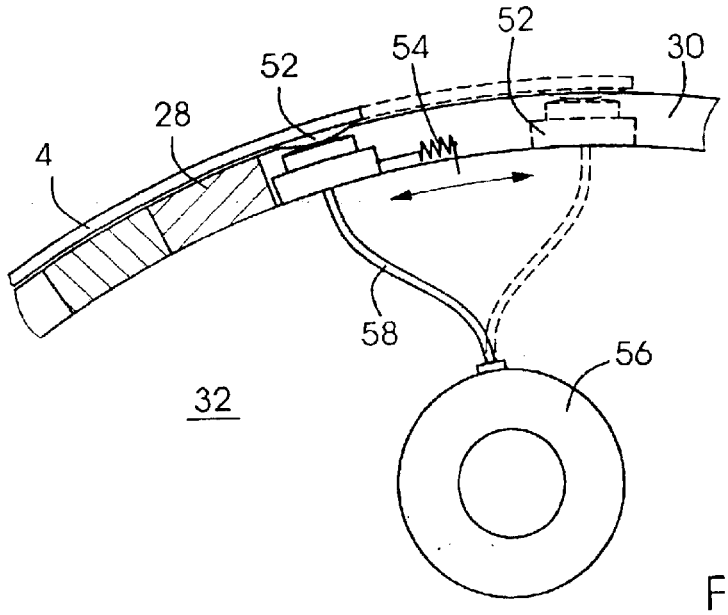
FIG. 6 is a fragmentary, sectional view of yet another embodiment of the invention, wherein movable suction devices are disposed in recesses, and apply a resilient tensioning force to the trailing edge of the sheets to be reversed or turned before the trailing edge is gripped by the gripper devices of the reversing or turning drum.

According to FIG. 6, in the recesses 24, suction devices 52 can be provided in the vicinity of the sheet trailing edge, the suction devices 52 serving for attracting by suction the sheet 4 that is to be reversed or turned at the trailing edge thereof and applying a resilient force thereto, in order to tauten the sheet before the sheet trailing edge is gripped by the gripping devices 20 of the reversing or turning drum 18. For this purpose, the suction devices 52 can, for example, be disposed so as to be displaceable within the groove 30 and, for example, braced against the central base member 32 of the impression cylinder 10 by a spring 54. In this case, the spring 54 is constructed as a tension spring. In the same way, however, it is conceivable for the suction devices 52 to be braced against the adjacent closure element 28 by a compression spring. The suction devices 52 are preferably connected via a conventional rotary valve 56 and a feed line 58 to a non-illustrated vacuum source.

According to a further embodiment of the invention, which is shown in FIGS. 7 to 9, the closure elements are formed by circular-ring segment-shaped elements 60 which are guided in the appertaining grooves 30 and have a curvature corresponding to the curvature of the circumferential surface 22 of the impression cylinder 10, and which are reciprocatingly moved up and down periodically in the radial direction between a retracted position 66 and an extended position 68 (FIG. 9) at the operating cycle rate of the sheet-fed rotary printing press 1 by an actuator 62 in the form of a control cam 64, illustrated in FIG. 9, and cam rollers 65 rolling thereon. The segment-shaped elements 60 are, in this regard, urged by resilient elements 70 in the direction of the rotational center of the impression cylinder 10, the radially outer faces of the segment-shaped elements 60, when they are in the extended position 68 thereof, serving for forming the circumferential surface of the impression cylinder 10 that carries the sheets 4 and, when they are in the retracted position 66, serving for forming the base of the recesses 24 into which the gripper devices 20 of the reversing or turning drum 18 dip or penetrate, for the purpose of taking over or accepting the trailing edge of a sheet 4 to be reversed or turned. In FIG. 9, the segment-shaped elements 60 are shown movable in the radial direction, at least approximately symmetrically to the mid-axis 76 thereof, via guide elements 74 which are guided in guides 72.

Figure 10:
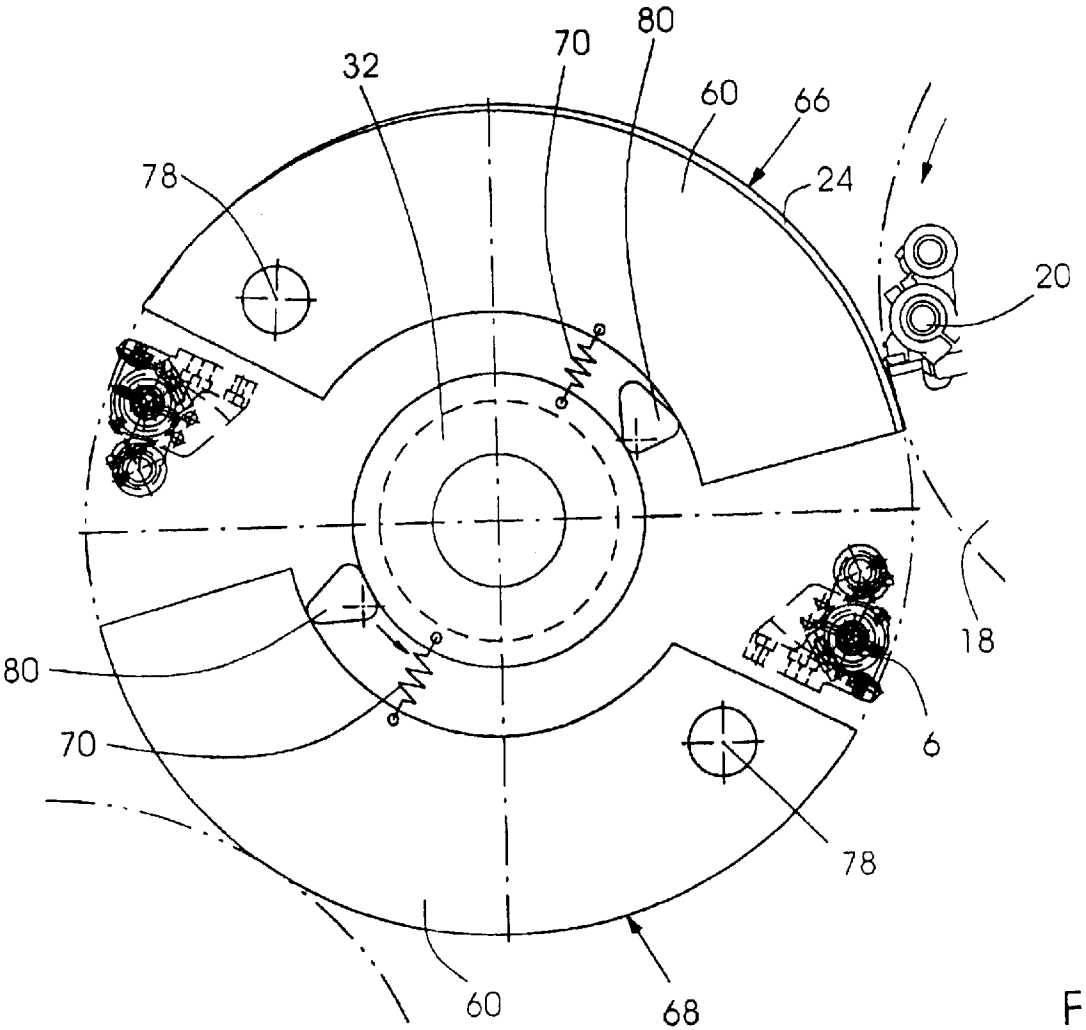
FIG. 10 is a view similar to that of FIG. 9 showing a further embodiment of the cylinder, wherein the circular-ring segment-shaped elements are pivotable and the circular-ring segment-shaped elements are adjustable by an adjusting cam that is supported on a central cylinder base member.

By contrast, in the embodiment of the invention illustrated in FIG. 10, the elements 60 are swiveled at the machine cycle rate about swivel axes 78, for which purpose the circular-ring segment-shaped elements 60 are braced against a corresponding component of the central base member 32 of the impression cylinder 10 by control cams 80 and resilient members 70.

Figure 11:
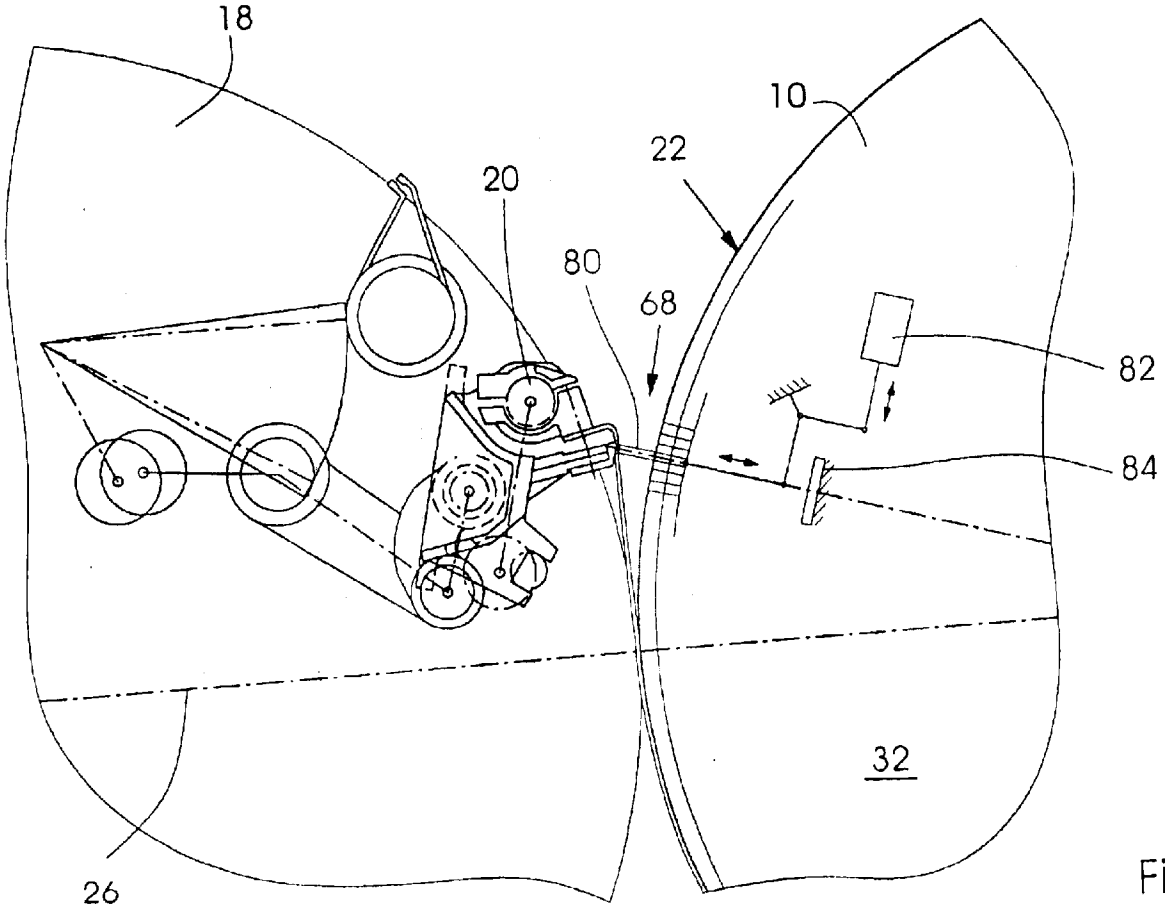
FIG. 11 is a view similar to that of FIG. 2 of yet a further embodiment of the invention, where the closure elements are periodically moved radially out of the circumferential surface of the impression cylinder by an actuating device, in order to lift the trailing edge of the sheets off the circumferential surface of the impression cylinder.

In the embodiment of the invention illustrated in FIG. 11, the closure elements which are moved periodically in the radial direction are formed by rod-shaped elements 80, which are moved out of the circumferential surface 22 of the impression cylinder 10 by a diagrammatically illustrated actuating device 82, for example a pneumatic cylinder, in order to lift the trailing edge of a sheet 4, which is to be reversed or turned, off the circumferential surface 22 of the impression cylinder 10 before the gripper center line 26, and to transfer the trailing edge to the gripper devices 20 of the reversing or turning drum 18, which, in this regard, preferably swivel out of the periphery of the reversing or turning drum 18 in order to grip the trailing edge of the sheet 4. In this case, the end face of the rod-shaped elements 80 is matched to the curvature of the circumferential surface, so that the rod-shaped elements 80 do not cause any impairment of the printed image when the sheet 4 to be printed passes the printing nip 14. In this regard, in the extended position 68 illustrated in FIG. 11, the rod-shaped elements 80 project out of the circumferential surface 22 of the impression cylinder 10, and, in the retracted position, are preferably braced against a support surface 84 disposed underneath the elements 80, so that the rod-shaped elements 80 are not lowered as they pass the printing nip 14.

We claim:

1. A reversing or turning assembly of a sheet-processing machine, comprising:

an impression cylinder having a circumferential surface for transporting sheets thereon for printing the sheets in a printing nip associated with the impression cylinder; and gripper devices for gripping the printed sheets at a respective trailing edge thereof and for lifting the gripped sheets off the impression cylinder for reversing the gripped sheets;

said circumferential surface of said impression cylinder being formed with recesses in a region thereof occupied by the trailing edge of the sheets, for permitting said gripper devices to penetrate or dip into said recesses to grip the sheet trailing edge;

said recesses having a position being variable in circumferential direction of said circumferential surface of said impression cylinder for adapting to different sheet formats.

2. The assembly according to claim 1, further comprising closure elements for closing said recesses to provide said circumferential surface, in a region thereof occupied by a printable region of a respective sheet, with a completely closed cylindrical shape upon said closure elements being disposed within said recesses.

3. The assembly according to claim 2, wherein said circumferential surface of said impression cylinder is formed with grooves for accommodating said closure elements therein.

4. The assembly according to claim 3, wherein a plurality of said closure elements lie in a row on one another within a respective one of said grooves, and are movable jointly in longitudinal direction of said one groove, to vary a position of said recesses for said gripper devices in circumferential direction of said circumferential surface of said impression cylinder for adapting to different sheet formats.

5. The assembly according to claim 4, further comprising chains for holding said closure elements, said chains, in said region of said circumferential surface of said impression cylinder occupied by said sheet leading edge, to be guided into an interior of said impression cylinder.

6. The assembly according to claim 4, further comprising suction devices disposed within a respective recess formed in said circumferential surface of said impression cylinder in said region thereof occupied by the trailing edge of the sheets, said suction devices being coupled with said movable closure elements for applying a resilient tensioning force to the sheets.

7. The assembly according to claim 2, further comprising:

a locking device for holding said closure elements in said recesses assigned thereto; and a removal device disposed outside a periphery of said impression cylinder for removing said closure elements from said assigned recesses in said radial direction after unlocking said locking device.

8. The assembly according to claim 7, wherein said locking device includes pulling elements assigned to said closure elements, said pulling elements, for fixing said closure elements, acting upon said closure elements from inside said impression cylinder in an at least approximately radial direction, for holding said closure elements on said impression cylinder.

9. The assembly according to claim 7, wherein said removal device includes a suction head for removing said closure elements from said recesses after releasing said locking device.

10. The assembly according to claim 2, wherein said closure elements are components reciprocatingly movable in radial direction between a retracted position and an extended position thereof periodically at an operating cycle rate of the sheet-processing machine.

11. The assembly according to claim 10, wherein said components are circular-ring segment-shaped members curved in accordance with a curvature of said circumferential surface of said impression cylinder, said circular-ring segment-shaped members being formed with radially outer faces forming said circumferential surface of said impression cylinder for carrying the sheets upon said members being in said extended position thereof, and forming a base of said associated recesses upon said members being in said retracted position thereof.

12. The assembly according to claim 11, further comprising an actuating device braced against a central base member of said impression cylinder for reciprocatingly moving said circular-ring segment-shaped components between said extended position and said retracted position thereof.

13. A reversing or turning assembly of a sheet-processing machine having a blanket cylinder, comprising:

an impression cylinder having a circumferential surface for transporting sheets thereon for printing the sheets in a printing nip associated with the impression cylinder;

gripper devices for gripping the printed sheets at a respective trailing edge thereof and for lifting the gripped sheets off said impression cylinder for reversing the gripped sheets; and rod-shaped closure elements disposed in said circumferential surface of said impression cylinder, said closure elements being reciprocatingly movable periodically, at an operating cycle rate of the sheet-processing machine, in radial direction between a retracted position and an extended position thereof, said closure elements having an end face matched to a curvature of said circumferential surface of said impression cylinder for lifting the trailing edge of the sheets to be reversed away from said circumferential surface of said impression cylinder, for gripping the trailing edge with said gripper devices, after those sheets have passed through a printing nip formed between said impression cylinder and the blanket cylinder.

* * * * *